US005628119A

United States Patent [19]

Bingham et al.

[11] Patent Number: 5,628,119

[45] Date of Patent: May 13, 1997

[54] ADJUSTABLE FRAMING JIG

[75] Inventors: Grady A. Bingham, Eden, N.C.; Victor C. Stone, Cascade, Va.

[73] Assignee: Old Stone Corporation, Eden, N.C.

[21] Appl. No.: 509,440

[22] Filed: Jul. 31, 1995

[51] Int. Cl.[6] ..... G01D 21/00

[52] U.S. Cl. ..... 33/613; 269/904

[58] Field of Search ..... 33/613; 269/43, 269/44, 45, 904, 905, 909, 910

[56] References Cited

U.S. PATENT DOCUMENTS

| | | | |
|---|---|---|---|
| 2,502,166 | 3/1950 | McKay | 269/905 |
| 2,509,236 | 5/1950 | Komar | 33/613 |
| 2,744,334 | 5/1956 | Jondole | 33/613 |
| 2,806,495 | 9/1957 | Merkle et al. | 269/45 |
| 3,201,874 | 8/1965 | Christy | 33/613 |
| 3,851,868 | 12/1974 | Lagasse | 269/904 |
| 3,888,477 | 6/1975 | Tate | 33/613 |
| 4,237,614 | 12/1980 | Williams | 269/43 |
| 4,350,279 | 9/1982 | Haley | 269/43 |
| 4,420,921 | 12/1983 | Hardin | 33/613 |
| 5,490,334 | 2/1996 | Payne | 33/613 |

*Primary Examiner*—Thomas B. Will

[57] ABSTRACT

A jig for framing as used in building construction is provided formed from metal or other suitable materials. The framing jig is adjustable for setting, for example, 2×4 wall studs on 16 inch centers. The framing jig includes right side legs and left side legs which are parallel so each side can receive a stud therebetween for attachment to a transverse header or other member. The framing jig can be adjusted for other stud spacings and by the use of wing nuts the jig is secured to prevent errors or slippage during stud placement.

11 Claims, 2 Drawing Sheets

ADJUSTABLE FRAMING JIG

BACKGROUND OF THE INVENTION

1. Field of the Invention

The framing jig shown herein is used in the building and construction trades for alignment of roof rafters, wall studs or the like. The device is particularly useful for carpenters or others of little experience and training in forming walls or roofs. The jig can be placed on a first stud which is properly aligned and allows the next stud to be properly spaced from the first while maintaining parallel alignment.

2. Background and Objectives of the Invention

With the rise in labor costs in recent years, the building and construction trades have sought more efficient methods in building homes, office buildings and other structures. Additionally, many builders have resorted to using inexperienced and illiterate workers for performing tasks that once only skilled carpenters and trained workers undertook. Using inexperienced workers can often initially save money, however if the inexperienced workers make mistakes due to their lack of knowledge, literacy or ability, the work often has to be redone, causing a waste in time, materials and customer satisfaction. In all "stick-built" homes and other buildings, walls are generally framed with 2×4's which are spaced on 16 inch centers. Other buildings are constructed with wall studs spaced at 24 inch centers. Roof rafters are generally similarly spaced on either 16 or 24 inch centers, depending on the particular load support required. 2×4's–2×12's are some of the most common components for wall studs and rafters used. It is most important that the wall studs and rafters be parallel and equally spaced, one from another to insure proper structural strength. Thus, with the necessity of using less experienced workers in the construction trades, the present invention was conceived and one of its objectives is to provide a device and method of using the same which is useful for aligning wall studs and rafters.

It is another objective of the present invention to provide an adjustable framing jig which can be easily set for an exact stud center alignment.

It is also an objective of the invention to provide an adjustable framing jig which insures proper stud alignment with minimum effort.

It is also an objective of the invention to provide an adjustable framing jig which is relatively light in weight and easy to handle.

It is another objectives of the invention to provide a framing jig which is relatively inexpensive to make and sell.

It is still another objective of the invention to provide a framing jig for those that cannot read a conventional ruler.

Various other objectives and advantages of the present invention will become apparent to those skilled in the art as a more detailed description is set forth below.

SUMMARY OF THE INVENTION

The framing jig as aforementioned is formed of light weight metal such as galvanized steel and includes left and right sections which are adjustably joined by threaded members secured by wing nuts. The left and right sections each include a top planar member which have a plurality of openings for coincidental alignment and securement with the threaded members or bolts. Pairs of depending legs are disposed at opposite ends of each of the left and right sections for receiving therebetween a 2×4, 2×6, or the like, as used in wall or roof framing. By setting the framing jig for sixteen inch spacings, the jig can then be used to align a series of wall studs on 16 inch centers with assurance that the studs are evenly spaced and are in parallel alignment with each other. To change the spacing, two wing nuts are removed and the left and right sections adjusted. The bolts and wing nuts are then replaced in coincidentally aligned openings whereby the jig can then be returned to service with the new spacing. Errors by inexperienced framers are eliminated and the wall construction proceeds rapidly therewith.

DETAILED DESCRIPTION OF THE PREFERRED EMBODIMENT

Figure 1:
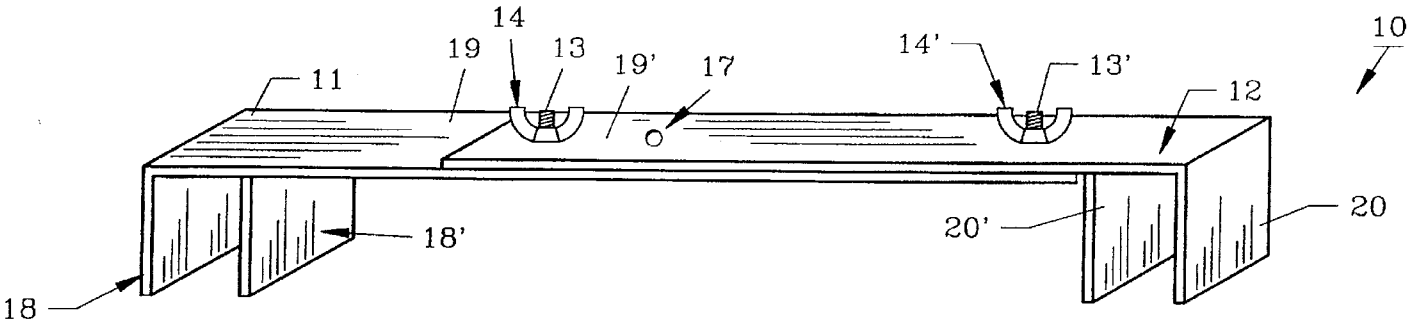
FIG. 1 shows a perspective view of the invention herein.

For a better understanding of the invention in its preferred form, turning now to the drawings, adjustable framing jig 10 is shown in a perspective view in FIG. 1 as formed from aluminum, galvanized steel or the like. Framing jig 10 comprises a left section 11 and a right section 12 which can be varied to accommodate 2×4's, 2×6's, 2×8's, 2×10's or the like on either 16 inch or 24 inch centers as used in roof framing, setting wall studs or the like. Left section 11 is affixed to right section 12 by use of bolts 13,13' and nuts 14,14' as seen in FIG. 1. As would be understood, openings 15, 15' in left section 11 are coincidentally aligned with openings 16, 16' respectively in right section 12 to provide a jig with preset distances for rafter or stud acceptance and placement.

Figure 2:
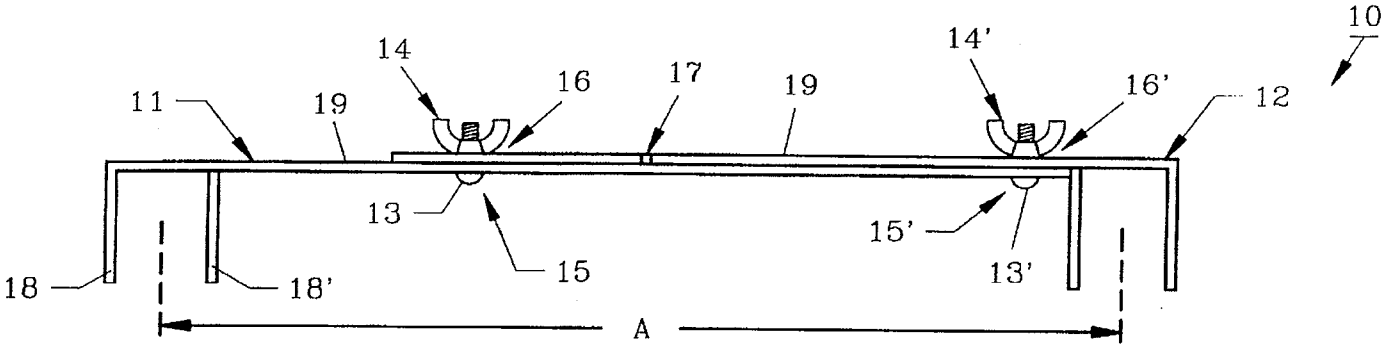
FIG. 2 depicts a front elevational view of the invention as shown in FIG. 1.
Figure 3:
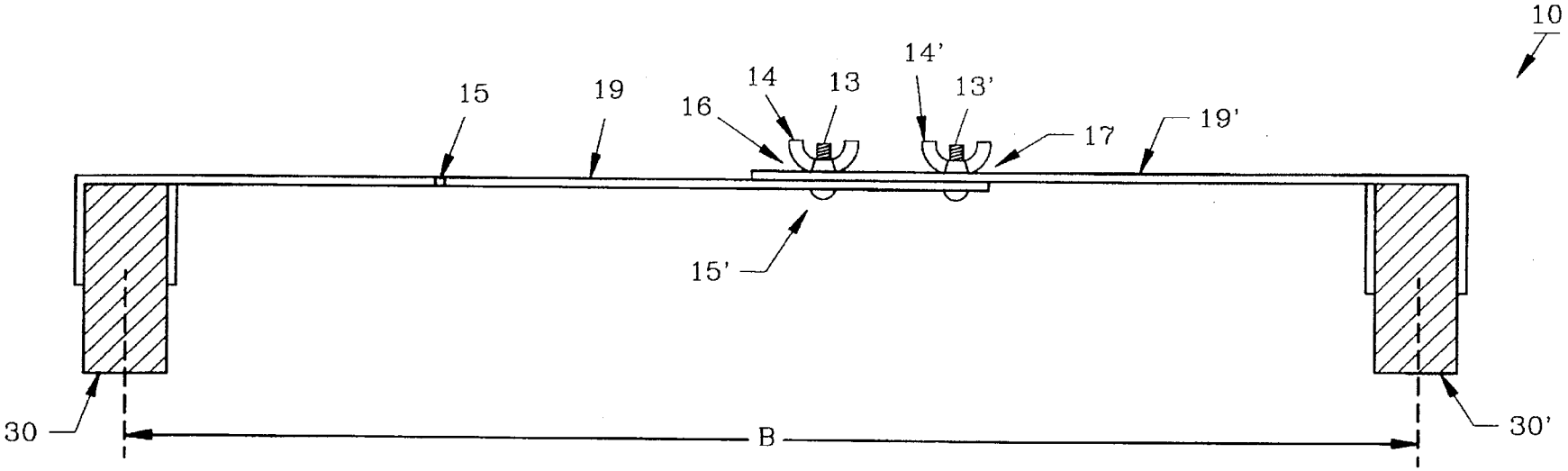
FIG. 3 illustrates the invention as seen in FIG. 2 but adjusted for a larger spacing.

Also in FIG. 2, bolt 13 passes through opening 15 in left section 11 and opening 16 in right section 12. Likewise, bolt 13' passes through opening 15' in left section 11 and opening 16' in right section 12. Jig 10 is held in its adjusted position by wing nuts 14, 14' on bolts 13, 13'. As further seen in FIG. 2, jig 10 is used to set studs or rafters as seen in FIG. 3, by sliding it over studs 30, 30' which are then temporarily held in parallel alignment until nailing or other fastening operation is concluded. Jig 10 has been adjusted to accommodate rafters, or the like, spaced on twenty-fourth inch centers as seen along distance B of FIG. 3, whereas in FIG. 2, jig 10 has been adjusted (shortened) for 16 inch rafter spacings as seen at A.

As further illustrated in FIGS. 1–3, jig 10 includes left section outer leg 18 and an inner leg 18' which have a depth of approximately two inches, the same depth as top planar member 19 and a length also of approximately two inches. Right section 12 likewise has an outside leg 20, an inside leg 20' and a top planar member 19' of the same dimensions.

Figure 4:
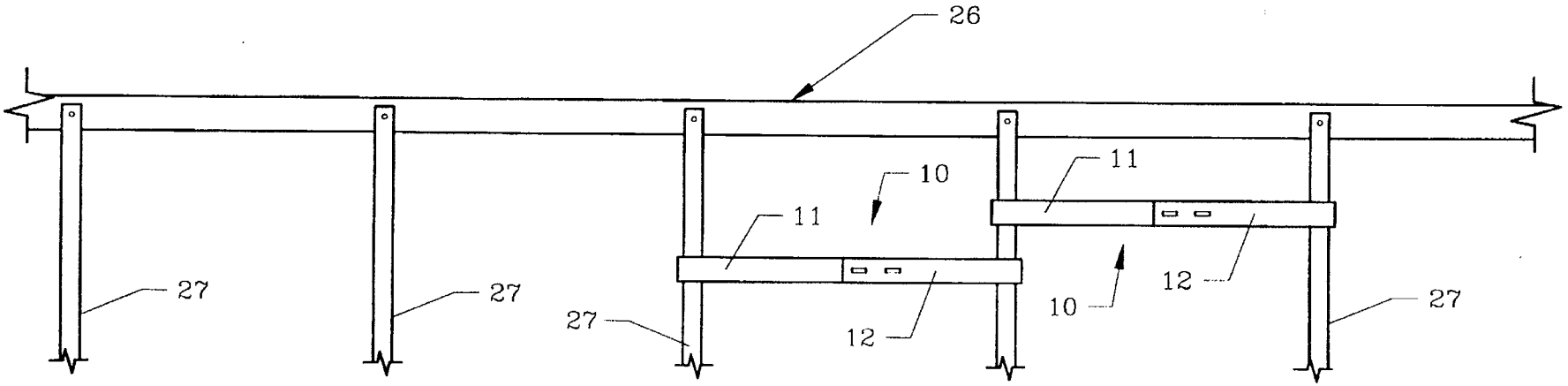
FIG. 4 demonstrates a view of a typical building structural unit with the invention depicted on transverse members such as 2×4's.

In FIG. 4, a building structural unit 25 which may be part of a wall, roof or the like, includes lateral member 26 which is supported by parallel transverse wooden 2×4's spaced therealong. 2×4's 27 are easily, equally spaced thereon by the use of jigs 10 whereby inexperienced framers can set members 27 with precise accuracy for attachment to lateral member 26. As seen in FIG. 4, transverse members 27 are spaced at twenty-four inch centers by the use of jig 10 adjusted as shown in FIG. 3.

Framing jig 10 is very easy to learn to use by inexperienced carpenters, framers or others. For framing a typical house wall with 2×4 inch studs as are commonly used, framing jig 10 is adjusted for sixteen (16) inch stud centers and is secured by turning the wing nuts as seen in FIG. 1. Next, left side legs 18,18' are placed over a properly positioned fixed stud which has been previously aligned. Then a new stud is selected and placed within the right side legs 20, 20'. Next, the newly selected stud is affixed in place such as by nailing or the like to a lateral member, such as lateral member 26 shown in FIG. 4. With the stud so affixed a new stud is likewise positioned, framing jig 10 moved to receive the new stud while positioned on the most recently affixed stud, and the process repeated for as many studs as required. This process of wall construction assures the workers of equally spaced studs which are in parallel alignment.

The exact dimensions of jig 10 as shown in FIGS. 1–4 (the preferred embodiment) of the invention although various modifications can be made by those skilled in the art. For example openings 15, 15', 16, 16' and 17 are circular openings for accepting bolts 13, 13'. Slots could likewise be used but circular openings prevent any mistakes in the exact adjustment of jig 10 and lessen the chance of error by its users. Other changes and modifications can likewise be made without departing from the intent of the invention such as providing adjustment lengths other than the two (16 inch and 24 inch) lengths depicted herein. Thus the examples presented are for illustrative purposes only and are not intended to limit the scope of the appended claims.

We claim:

1. A framing jig comprising: a left section, a right section, said left section adjustably affixed to said right section, said left section comprising a left planar member, an outside left leg, an inside left leg, said outside left leg parallel to said inside left leg, said inside and said outside left legs attached to said left planar member, said right section comprising a right planar member, an outside right leg, an inside right leg, said right inside leg parallel to said right outside leg, said inside and said outside right legs attached to said right planar member, said left planar member and said right planar members each defining three circular openings whereby said circular openings of said left planar member and said right planar member can be selectively coincidentally aligned and fastened for adjusting said framing jig.

2. The framing jig of claim 1 wherein said left and said right sections are formed from metal.

3. The framing jig of claim 1 wherein said right planar member is fastened to said left planar member with a pair of threaded bolts.

4. The framing jig of claim 3 and including a pair of wing nuts, said wing nuts for securement of said threaded bolts.

5. The framing jig of claim 1 wherein said left section outside leg is parallel to said right section outside leg.

6. A framing jig for aligning structural members comprising: a left section, a right section, said left section adjustably affixed to said right section, said left section comprising a left planar member, an outside left leg, an inside left leg, said outside left leg parallel to said inside left leg, said inside and said outside left legs depending from said left planar member and for receiving a structural member therebetween, said right section comprising a right planar member, an outside right leg, an inside right leg, said right inside leg parallel to said right outside leg, said inside and said outside right legs depending from said right planar member and for receiving a structural member therebetween, said left planar member and said right planar members each defining three circular openings whereby said circular openings of said left planar member and said right planar member can be selectively coincidentally aligned and fastened for aligning said structural members received.

7. The framing jig of claim 6 wherein said left and said right sections are formed from metal.

8. The framing jig of claim 6 wherein said left section legs and said right section legs are of equal lengths.

9. A framing jig, comprising:

(a) a right section including a right planar member, a right outer leg, and a right inner leg, the right inner leg and the right outer leg rigidly attached to the right planar member, the right inner leg parallel to the right outer leg, the right inner leg and the right outer leg perpendicular to the right planar member, and the right planar member defining three circular openings;

(b) a left section including a left planar member, a left outer leg, and a left inner leg, the left inner leg and the left outer leg rigidly attached to the left planar member, the left inner leg parallel to the left outer leg, the left inner leg and the left outer leg perpendicular to the left planar member, the left planar member parallel to the right planar member, and the left planar member defining three circular openings; and (c) a pair of threaded bolts connecting the left planar member to the right planar member, one each of said threaded bolts positionable in one of the circular openings of the right planar member and in one of the circular openings of the left planar member.

10. The framing jig of claim 9, and including a pair of wing nuts, one each of said wing nuts positionable upon one each of said threaded bolts.

11. The framing jig of claim 9, wherein said left section and said right section are formed from metal.

* * * * *